United States Patent [19]

Farkas

[11] Patent Number: 5,044,171

[45] Date of Patent: Sep. 3, 1991

[54] COUNTER WITH INTEGRAL CARBONATED BEVERAGE DISPENSER

[76] Inventor: Eli Farkas, 3842 Neptune Ave., Brooklyn, N.Y. 11224

[21] Appl. No.: 432,375

[22] Filed: Nov. 6, 1989

[51] Int. Cl.[5] ..... B01F 3/04

[52] U.S. Cl. ..... 62/306; 62/391; 222/146.6; 251/238

[58] Field of Search ..... 62/389, 390, 391, 394, 62/306-308; 251/237, 238; 222/146.6

[56] References Cited

U.S. PATENT DOCUMENTS

| | | | |
|---|---|---|---|
| 716,474 | 12/1902 | Price | 62/306 X |
| 2,076,922 | 4/1937 | Simard | 62/390 X |
| 2,135,821 | 11/1938 | Levings | 62/390 X |
| 2,159,729 | 5/1939 | Ribble | 62/389 X |
| 2,247,590 | 7/1941 | Strong | 251/238 |
| 2,677,241 | 5/1954 | Schmock | 62/390 X |
| 3,262,442 | 8/1966 | Timmersman | 62/394 |
| 3,305,136 | 2/1967 | Harris | 62/390 X |

*Primary Examiner*—William E. Tapolcai
*Attorney, Agent, or Firm*—Michael I. Kroll

[57] ABSTRACT

A counter with internal carbonated beverage dispenser is disclosed. A counter with a bottom platform, a refrigerating unit disposed on the bottom platform and under the counter, a mixing drum disposed on the bottom platform and under the counter, and a carbon dioxide cylinder disposed on the bottom platform and under the counter so that all of the unsightly components are hid under the counter.

8 Claims, 2 Drawing Sheets

COUNTER WITH INTEGRAL CARBONATED BEVERAGE DISPENSER

BACKGROUND OF THE INVENTION

1. Field of the Invention:

The present invention relates to a carbonated beverage dispenser.

More particularly, the present invention relates to a carbonated beverage dispenser located entirely out of sight below a counter.

2. Description of the Prior Art:

The U.S. Pat. No. 3,953,550 to Gilbey relates to apparatus which can be connected to a cylinder containing $CO_2$ so that water, still wines, milk, and soft drinks of all kinds can be aerated.

At present it is normally customary to provide the gas in what can be termed "commercial" types of cylinders which are large and bulky and not easy to handle.

The U.S. Pat. No. 3,953,550 to Gilbey teaches a portable free standing or wall mounted aerating apparatus which is inexpensive to construct and simple to operate, and which can be used in the home and small establishments in combination with a comparatively small cylinder for the gas that has an outlet valve which can be readily connected to a gas cylinder holder of the apparatus, and which is actuated by means provided on the latter.

The U.S. Pat. No. 4,251,473 to Gilbey relates to portable apparatus for carbonating water, suitable for use, for example, in homes, offices, restaurants, and bars.

In the first category, a bottle containing water is mounted in the machine and water is carbonated in the bottle which is then removed from the apparatus. Apparatus of this type is described, for example, in British Patent Specification No. 145 3363 and has been widely marketed in Great Britain and elsewhere.

In the second category of apparatus, the apparatus includes a pressure vessel and a header tank. The vessel has a valved bottom inlet to admit fresh water from the header tank to the pressure vessel. A valved outlet in an upper region of the vessel is provided for discharging carbonated water. And an injection nozzle for admitting $CO_2$ under pressure.

Fresh water is carbonated within the vessel and the outlet and inlet are opened to admit fresh water from a header tank to the bottom inlet. The fresh water displaces the carbonated water upwardly in the vessel and through the outlet. This type of apparatus is described, for example, in British Patent Specification No. 392,750.

In the apparatus described in U.S. Pat. No. 392,750, the inlet and outlet valve members take the form of poppet type, which face sealing valves.which are spring loaded against their respective valve seats. Because the valves must resist the pressure generated in the vessel during carbonation, it is necessary for the spring acting on the outlet valve to be sufficiently powerful to resist the pressure tending to blow the valve off its seating. This in turn means that a correspondingly large force must be applied to open the valve when the carbonated water is to be discharged, with the result that the apparatus may be difficult to operate by a woman or child, unless, of course, a somewhat complex mechanism is designed to provide a suitable mechanical advantage. The mechanism is in any case slightly complicated by the need to provide lost motion between the two valves, so that the outlet will always be opened in advance of the inlet.

The U.S. Pat. No. 4,251,473 to Gilbey teaches a portable apparatus for carbonating water, and which includes a pressure vessel and a header tank. The vessel has a valved bottom inlet to admit fresh water from the header tank to the pressure vessel. And a valved outlet in an upper region of the vessel for discharging carbonated water. And an injection nozzle for admitting $CO_2$ under pressure. The inlet and outlet valves take the form of pistons which are rigidly connected together to form a unitary plunger that has equal areas exposed within the pressure vessel, so that the plunger is substantially pressure balanced.

The U.S. Pat. No. 4,298,551 to Adolfsson et al. relates to an appliance for making an aerated beverage.

Appliances have been proposed for making aerated beverages in the home. One known form of such an appliance includes a casing that has means for mounting a container of pressurized carbon dioxide on the casing. A manually operable valve is provided to control the outflow of carbon dioxide from this container. A nozzle is connected to the valve to receive carbon dioxide from the valve. And means are provided for mounting a bottle that contains water in such a way that the nozzle is immersed in the water in the bottle. The appliance also includes an overpressure safety valve which can communicate with the interior of the bottle.

The means for mounting the bottle include a shatterproof housing, made of metal and which surrounds the bottle. This shatterproof housing is being pivotally mounted on the casing. The bottle is inserted into the shatterproof housing in such a way that the depending nozzle extends into water in the bottle. The housing is pivoted to a vertical position and a lever is operated to lift, by means of a cam, a table which urges the bottle upwardly against a stopper within the shatterproof housing.

With the bottle so mounted, the manually operate valve is actuated and carbon dioxide is projected through the nozzle into the water and goes into solution. When the pressure reaches a preset value, the safety valve opens which usually makes a buzzing sound to indicate that the bottle can be removed.

In order to remove the bottle, the lever is actuated again so that the table is lowered and the housing is then pivoted out and the bottle removed. The aerated drink can simply be soda water or can have added to it a suitable flavoring concentrate or syrup to provide drinks such as cola, tonic water, etc.

These appliances are reasonably satisfactory, but they do require several operations before an aerated beverage can be made.

The U.S. Pat. No. 4,298,551 to Adolfsson et al. teaches an appliance for making an aerated beverage including a casing. Means for mounting the container of pressurized carbon dioxide in the casing. A manually operable valve to control the outflow of carbon dioxide from the container. A nozzle connected to the manually operable valve to control the outflow of carbon dioxide from sad container. A nozzle connected to sad manually operable valve to receive carbon dioxide from the valve. Means for mounting a bottle containing water so that the nozzle is immersed in the water in the bottle. A flexible diaphragm surround the upper end of the nozzle. A stopper carried by the diaphragm and closes the neck of the bottle when so mounted. A space formed above the diaphragm communicating with the interior of the bottle when mounted with the stopper in its neck. The upwardly projected area of the diaphragm forms a wall of the space being greater than the downwardly projected area of the stopper. The pressure of the carbon dioxide urges the stopper into engagement with the neck of the bottle. And an overpressure safety valve communicates with the space above the diaphragm.

The U.S. Pat. No. 4,342,710 to Adolfsson et al. relates to an apparatus for aerating a liquid, such as water, and flavored water, for preparing aerated beverages.

Several apparatus to be used for this purpose are previously known. All of which include a stand and a sealing member for sealing the mouth of a glass bottle during the aeration process. Carbon dioxide is supplied to the interior of the bottle through a pipe extending through the sealing member, and aerates the contents in the bottle.

At one such known apparatus, which is disclosed in GB-PS 1 468 469, a sealing member includes a rubber cone movable against the pressure from a spring, is positioned in the upper portion of a cylinder, which is hingedly attached in the stand to its upper portion. The cylinder constitutes a protection against bursting. The glass bottle is inserted from below into the cylinder, in that the cylinder is swung outward so that its lower end is located outside the stand. Thereafter the cylinder is swung inward to the stand to a substantially vertical position whereafter the bottle is pressed against the resilient sealing member due to co-operation of the bottle with a supporting surface on the stand.

The protection against bursting is extremely important. Glass bottles that have been used and reused may be damaged or have material defects, which may cause the bottle to burst to pieces at the aerating process, which takes place at a relatively high pressure.

This known apparatus, however, has the disadvantage that when the high pressure in the bottle during the aerating process has not been vented sufficiently, the bottle at the outward pivotal movement of the cylinder for removing the bottle will be pushed out of the cylinder with great force and may injure the operator.

A serious risk involved with the known apparatus in this connection is, that children handling the apparatus at home my pivot the cylinder outward when the bottle is under pressure, whereby the bottle is ejected from the cylinder with very great force.

A further disadvantage is, that it is relatively difficult to insert the bottle, because the mouth of the bottle must be fitted against the sealing member, which is not visible at the moment of insertion. The bottle, moreover, may easily be dropped when it is to be removed from the cylinder.

The U.S. Pat. No. 4,342,710 to Adolfsson et al. teaches an apparatus including a stand in which space is assigned for a glass bottle and for a gas tube containing carbon dioxide, and a sealing member for sealing the mouth of a glass bottle during the aeration process. Through which sealing member a pipe for carbon dioxide extends and opens beneath the sealing member.

At the space assigned for the glass bottle a bursting protection is provided, which is movable upward and downward relative to the stand and to a glass bottle positioned as intended. Bursting protection in its upper position permits free placement of a bottle standing in a place assigned for this purpose in the lower portion of the stand. And which in its lower position entirely encloses a bottle thus positioned. And the sealing member is located in the upper portion of the bursting protection and capable to be caused to seal against the mouth of a bottle only when the bursting protection is in its lower position.

The U.S. Pat. No. 4,391,762 to Child et al. relates to an appliance for making an aerated beverage.

One form of device for making an aerated beverage, for example, such as described in British Pat. No. 1453367 and also in an Application published under No. 2026882. The device includes a casing in which is enclosed a container of pressurized liquid carbon dioxide and is connected thereto by a manually operable valve. An elongate nozzle which is either permanently angle downwardly and forwardly or is pivotally pivotable between such a position and the vertical position. The bottle which is partly filled with water is moved upwardly relative to the nozzle so that the nozzle is immersed in the water, with the nozzle in the inclined position. The bottle is held in position with its neck against the stopper at the top of the nozzle after pivoting the nozzle to the vertical position. The appliance also includes a shatterproof housing which surrounds the bottle when it is in position around the nozzle.

The manually operated valve is actuated a few times and carbon dioxide gas is thus introduced into the water. A safety valve is provided which releases any excess pressure which may occur in the bottle. The bottle is then removed from the appliance and its contents are either used in this form as soda water, or a concentrate flavoring syrup is added to obtain an aerate beverage, such as lemonade, tonic water, and cola, etc.

Such an apparatus is generally satisfactory but the amount of carbon dioxide used can be in excess of that which is necessary to aerate the beverage. The reason for this is that it is customary for the bottle to be filled with water to a level so that the water occupies about three quarters of the total volume of the bottle. This reduces the chance of the mixture of the aerated water and syrup effervescing over the neck of the bottle which would clearly be both wasteful and messy. The space above the water, however, becomes filled with pressurized carbon dioxide which is subsequently wasted when the bottle is removed from the stopper.

The U.S. Pat. No. 4,391,762 to Child et al. teaches an appliance that has, associated with the nozzle, a displacement body which is capable of being passed into the neck of the bottle and which will displace a significant volume of air and/or water, so that when the bottle is in position, with the nozzle and displacement body therein, the level of the water is such as to leave only a small volume of air thereabove.

The U.S. Pat. No. 4,399,081 to Mabb relates to portable apparatus for aerating liquids.

In known apparatus which is disclosed in British patent No. 1,453,363, a bottle containing liquid to be carbonated is, after being loaded into the machine, raised into sealing engagement with an aerating head, by a platform. The platform itself is lifted by a cam mechanism which is mounted within the machine casing and is rotated by means of a handle with the cam shaft outside the housing. The platform has an integral rigid stem which bears against the cam. As the handle is turned to raise the bottle, the cam rotates lifting the platform and bottle until the top of the bottle bears against the seal of the aerating head. Continued turning of the handle to its limit position causes further rotation of the cam, but because the bottle and platform cannot be raised any further, the cam is deflected downwardly. When the bottle is pressurized during the carbonating process, the gas pressure generated in the air space above the liquid in the bottle produces an additional downward force on the bottle and its supporting platform with the result that the cam mechanism undergoes further deflection. The repeated bending of the cam shaft caused by the downward deflection of the cam is of course an undesirable effect arising due to the rigidity of the bottle raising mechanism. A further disadvantage can arise because the glass bottles for the liquid can only be made to a certain height tolerance. And short bottles may not be lifted high enough by the lifting mechanism to form an effective seal with the aerating head.

The U.S. Pat. No. 4,399,081 to Mabb teaches a portable apparatus for aerating liquids, including an aerating head, means for supplying gas to the aerating head, a platform for lifting a bottle containing liquid to be aerated into sealing engagement with the aerating head, means operable to raise the platform, and a resiliently compressible element interposed between the raising means and the platform. The element is arranged to be compressed when a bottle is lifted into engagement with the aerating head whereby to ensure adequate sealing pressure between the bottle and the aerating head.

The U.S. Pat. No. 4,401,016 to Adams et al. relates to an appliance for making an aerated beverage.

Conventionally, an appliance of this type can consist of a casing in which is enclosed or mounted a container of pressurized liquid carbon dioxide. Connected to this container, by a manually operated valve, is an elongate nozzle which is either permanently angled downwardly and forwardly or is pivotable between such a position and a vertical position. A bottle, which is partly filled with water, is moved upwardly relative to the nozzle so that the nozzle is immersed in the water with the nozzle in the inclined position. The bottle is held in place with its neck against a stopper at the top of the nozzle after pivoting the nozzle to the vertical position. The appliance also includes a shatterproof housing which surrounds the bottle when it is in position around the nozzle.

A manually operated valve is actuated a few times and carbon dioxide gas is thus introduced into the water. The safety valve is provided which releases any excess pressure which may occur in the bottle which may thereafter be removed from the appliance. Its contents are either used in its form, as soda water, or as a concentrate flavoring syrup added to obtain an aerated beverage such as lemonade, tonic water, or cola, etc.

Such a construction is relatively complex and expensive to manufacture.

The U.S. Pat. No. 4,401,016 to Adams et al. teaches an appliance for making an aerated beverage. The appliance includes a casing, a support member pivotally mounted on the casing, a connection carried by the support member for mounting a container of pressurized liquid carbon dioxide, a shatterproof housing for a bottle of water carried by the support member, a nozzle communicating with the connection and extending from the support member downwardly within the housing, a stopper for engaging in the neck of a bottle, means for supporting the bottle in the housing so that the stopper is engaged therein, and a safety pressure valve connected to the interior of the bottle when the stopper is engaged in its neck.

The pivotable connection between the casing and the support member causes the shatterproof housing, the nozzle, the stopper, and the container of pressurized liquid carbon dioxide all to pivot therewith relative to the casing as a pivotal assembly from a first position in which the bottle can be introduced into or removed from the housing and a second position in which the means for supporting the bottle engage the bottle to prevent its removal.

The U.S. Pat. No. 4,514,994 to Mabb relates to apparatus for aerating carbonated water.

Known types of aerating apparatus include industrial plants for large scale production of bottled beverages including carbonated water. Smaller plants of a commercial size for use in making carbonated drinks at the location of sale to the public is provided. For example a bar or restaurant, and portable machines for domestic household use. The last mentioned devices are simple and compact compared with the industrial and commercial carbonating plants, and have become popular in recent years.

It is well known that the carbonation of water is improved if the water is chilled prior to introducing the carbon dioxide gas. For this reason it is usual to include in the known industrial and commercial plants a cooler for cooling the water before carbonation. In the case of the known portable machines intended for domestic use, however, incorporating a cooling mechanism for cooling the water is not considered a practical proposition since it would complicate the device, substantially increase its cost and make it less compact.

Consequently, it is suggested that bottles of water be chilled in a refrigerator before being carbonated using the portable machines, but this is often inconvenient. As a solution to this drawback, it has been proposed to provide the portable apparatus with a detachable reservoir tank from which the water is drawn into a pressure chamber for carbonation. A spare tank of water is kept within the refrigerator so that it is well cooled when mounted on the apparatus. The result is satisfactory only if the entire contents of the reservoir are carbonated upon being removed from the refrigerator. Otherwise the uncarbonated water soon returns to ambient temperature. There is also a disadvantage in the need to replace continually the reservoir tank and remember to store the spare tank in the refrigerator.

U.S. Pat. No. 2,103,479 provides a carbonator housed entirely within the food compartment or a refrigerator.

The carbonator is connected to the water supply system, which is inconvenient since it means that the refrigerator must be plumbed in to the household water supply. The apparatus is also inconvenient to use since the refrigerator door must be opened to gain access to the controls and the discharge nozzle of the carbonator. Furthermore it enables only a relatively small volume of water to be cooled ready for carbonation so it is not capable of succession. An additional disadvantage is that the carbonated water is discharged under pressure which can cause foaming and splashing within the refrigerator.

The U.S. Pat. No. 4,514,994 to Mabb teaches a solution to the above drawbacks. In accordance with a first broad aspect resides in a domestic refrigerator that has a cold food compartment defined within a walled cabinet including a door, and a carbonating apparatus mounted within the cold chamber and operable to deliver carbonated liquid to a discharge nozzle. The carbonating apparatus is mounted on the inside of the refrigerator door and a sealed pressure chamber and a reservoir, both exposed to the temperature in the cold compartment. Valve means to control supply of liquid to the pressure chamber from the reservoir tank and discharge of liquid from the pressure chamber to the nozzle. A gas supply valve for controlling supply of pressurized gas from a gas source to the pressure chamber. An exhaust valve operable to release the gas pressure in the pressure camber. A control arrangement extending through the refrigerator door to be operable from outside the cold compartment. A the discharge nozzle is mounted to deliver liquid on the outer side of the door.

The U.S. Pat. No. 4,518,541 to Harris relates to carbonating water to make fizzy drinks.

The portable carbonating machines currently available for use in the home are entirely mechanically operated. A person using one of these machines is required to perform a series of manual operations in a specified sequence, if a satisfactory result is to be achieved. As a result, children and persons unfamiliar with this kind of carbonating apparatus can experience difficulty in using the machines. Portable carbonators of the mechanical type are described, for example, in Patent Specification Nos. GB No. 1453363, GB No. 1468469, and GB No. 2026882.

A carbonating apparatus includes a carbonating chamber. First valve means for controlling admission of liquid to and discharge of carbonated liquid from the chamber. A gas jet nozzle mounted in the chamber for injecting carbon dioxide gas into liquid contained in the chamber. Means for connecting the jet nozzle to a source of pressurized gas including second valve means for controlling the supply of gas. Pressure releasing means communicating with an upper part of the chamber and including third valve means. The first, second, and third valve means are electrically actuable and controlled by electronic control means which is so programmed that in response to a start signal supplied to the control means, the first valve means is actuated for the admission of liquid to the chamber to substantially fill the chamber. After closure of the first valve means, the second valve means is actuated one or more times for periods of set duration or when gas is to be supplied to the jet nozzle and injected into the liquid. After termination of the gas supply and a short delay the third valve means is opened to release the pressure in the chamber. Following further short delay after opening the exhaust valve the first valve means may be actuated for carbonated liquid to be discharged from the chamber.

The U.S. Pat. No. 4,518,541 to Harris teaches a control means including an electronic timer control device which actuates the first valve means for a predetermined time for admission of liquid into the chamber, and enables the first valve means to be actuated to discharge liquid from the chamber after a predetermined delay has elapsed after opening the third valve means. A timer control device has the advantage of simplifying the apparatus by avoiding the need for sensor or feedback signals to determine when each stage in the operation has been completed and the next can be commenced. However, means to provide such signals is desirable and is included in the apparatus.

The U.S. Pat. No. 4,588,536 to Adolfsson relates to apparatus for supplying gas to a liquid in a container has been; a gas conduit discharging thereinto for preparing aerated beverages. Arranged in the upper part of the container is an orifice through which liquid is introduced into the container.

For the purpose of preparing aerated beverages on a small scale, for example in the home, apparatus are known by means of which carbon dioxide can be supplied to water in a bottle, the water then being flavored with a flavoring substance. In the preparation of such beverages, it is necessary first to fill a bottle with water up to a given level, and then to hold the bottle firmly gripped in the apparatus while supplying carbon dioxide to the water. The bottle is then removed from the apparatus and the flavoring substance added. The beverage is then ready to be poured into a drinking glass or like vessel.

In addition to being relatively complicated, since among other things it requires the use of a separate bottle whose shape and size are adapted to the apparatus in question, the aforedescribed procedure for preparing aerated beverages is also encumbered with other problems and safety risks.

Among other things, it is difficult to obtain a good seal when using standard bottles, since the bottles can vary greatly in height. In addition, risks are involved when subjecting return bottles to pressure, since in addition to uneven manufacturing quality the bottles may have been damage during previous use or in transportation. Further, in the case of known apparatus the bottle can be pressurized without having been filled with liquid, which presents a risk of serious injury should the bottle explode. It is also possible with known apparatus to overfill the bottle with liquid, rendering it impossible to supply sufficient carbon dioxide to the liquid. In order to aerate a liquid effectively in a container, it is necessary to provide above the surface of the liquid a space in which the gas can be compressed.

It has also been proposed to introduce carbon dioxide into a liquid enclosed in a container fixed in an apparatus, and to pour the aerated liquid directly from the container into a glass. The use of this container is also relatively complicated. However, and in some respects the arrangement is unsafe. For example, it is possible with such known apparatus to pressurize an empty container. Furthermore, it is possible to begin to pour liquid from the container while the container is still under high pressure.

Apparatus of the kind mentioned in the aforementioned disadvantages are eliminated in U.S. Pat. No. 4,509,569.

The U.S. Pat. No. 4,588,536 to Adolfsson teaches that the filling orifice of the container is provided with a closure means which is arranged to close the orifice automatically in conjunction with supplying gas to the container. Among other things, such an arrangement obviates the need for additional manual handling of the container when supplying carbon dioxide thereto. Such additional manual handling readily being forgotten. Furthermore, with such an arrangement the filling orifice is normally open, which facilitates both filling of the container and the pouring of liquid therefrom.

The U.S. Pat. No. 4,610,282 Brooks relates to a portable apparatus for carbonating water to prepare carbonated drinks.

In one known form of liquid carbonating apparatus the liquid to be carbonated is placed into a bottle and the bottle is loaded into a carbonating machine. A seal member is adapted to engage and seal closed the neck of the bottle, while a tube carrying a gas nozzle extends through the seal member and down into the bottle for injecting carbon dioxide gas into the liquid container in the bottle. The upper end of the gas tube is connected to a gas cylinder via a valve which is operated manually to supply gas to the injection nozzle. In order to limit the maximum pressure within the bottle, an exhaust passage is provided through the seal member and communicates with atmosphere through a relief valve which is arranged to open when the maximum pressure is exceeded.

In general, the known carbonating apparatus of the above type operates satisfactorily. It does, however, suffer from certain drawbacks.

Difficulty is sometimes experienced in achieving a satisfactory seal between the bottle and the sealing member, for example, as a result of variations in bottle heights due to manufacturing tolerances.

In an attempt to solve the problem of the seal member and the bottle neck becoming forced apart by the pressure generated in the bottle during carbonation so that leakage occurs between the bottle and seal member, it has been proposed to support the seal member on a movable wall member, i.e. a diaphragm, or a piston, whose upper surface has an area greater than that of the bottle neck and is exposed to the same pressure as that which exists in the bottle. For this purpose a chamber defined on the upper side of the wall member communicates with the exhaust passage through the seal member. With this arrangement, the seal member is pressed down against the bottle neck with increasing force as the gas pressure rises thereby reversing the tendency for the bottle and seal member to move apart. The arrangement is not however without problems. The resultant downward force on the seal member is only obtained once a positive pressure has been created in the chamber above the movable wall. An initial seal is still required between the bottle and the seal member. As the pressure of the first burst of gas injected into the bottle is felt within the bottle neck before it reaches the chamber above the movable wall the initial sealing pressure must be capable of preventing the seal member from disengaging the bottle under this burst of pressure.

A spring or the natural resilience of the diaphragm may be utilized in an attempt to ensure the initial sealing engagement. But, the magnitude of the initial sealing pressure required can lead to the seal member becoming damaged or worn by the bottle loading operation, especially if the bottle happens to be twisted as it is inserted.

It has also been suggested to use an inflatable sealing member which is inserted into the bottle neck and is expanded into sealing engagement with the neck by the pressure of the gas delivered into the bottle. In order to operate correctly, only a small initial clearance is allowable between the sealing member and the bottle. Since it must be introduced into the bottle neck there is still a danger of it becoming worn and damaged if the bottle is not positioned in accurate alignment with it. An inflatable sealing member is also more complicated and expensive to manufacture.

The U.S. Pat. No. 4,588,536 to Adolfsson teaches an apparatus for carbonating liquid contained in a bottle including sealing means for engaging and sealing closed the neck of the bottle, gas injecting means projecting downwardly from the sealing means for injecting gas into the liquid, means for supporting the bottle in a predetermined position with the neck of the bottle adjacent the seal means and the gas injecting means extending down into the liquid in the bottle, movable wall means carry the sealing means and movable under pressure in a chamber defined on the side thereof remote from the sealing means, and wall displacing means actuable the movable wall means downwardly for moving the sealing means before or as gas is first injected into the bottle from a position spaced above the bottle neck to a position of firm sealing engagement with the neck.

The teachings of U.S. Pat. No. 4,401,607 to Child et al. and the U.S. Pat. No. 4,422,371 to Child et al. are of similar construction as those discussed in the patents, supra. Numerous innovations for a counter with integral carbonated beverage dispenser have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a carbonated beverage dispenser.

More particularly, it is an object of the present invention to provide a carbonated beverage dispenser located entirely out of sight below a counter.

In keeping with these objects, and with others which will become apparent hereinafter, one feature of the present invention resides, briefly stated, in a counter with internal carbonated beverage dispenser including: a counter with a bottom platform, a refrigerating unit disposed on the platform bottom and under the counter, a mixing drum disposed on the platform bottom and under the counter, and a carbon dioxide cylinder disposed on the platform bottom and under the counter.

When the counter with integral carbonated beverage dispenser is designed in accordance with the present invention, all of the unsightly components are hid under the counter out of sight.

In accordance with another feature of the present invention, the refrigerating unit is disposed adjacent to the mixing drum so that the contents of the mixing drum remains cold.

Another feature of the present invention is that the mixing drum is substantially cylindrical shaped and contains three orifices.

Yet another feature of the present invention is that the three orifices are a water inlet, a carbon dioxide inlet, and a carbonated beverage outlet.

Still another feature of the present invention is that the carbon dioxide inlet contains a check valve so that the carbon dioxide flows only in one direction.

Yet still another feature of the present invention is that the carbonated beverage outlet contains a check valve so that the carbonated beverage flows only in one direction.

Still yet another feature of the present invention is that it further includes a carbon dioxide conduit connecting the carbon dioxide cylinder to the check valve at the carbon dioxide inlet so that the carbon dioxide in the cylinder flows only in one direction.

Another feature of the present invention is that it further includes a water conduit connecting the mixing drum to a water supply.

Yet another feature of the present invention is that it further includes a carbonated beverage conduit connecting the carbonated beverage outlet to the outlet pipe.

Still another feature of the present invention is that it further includes a handle pivotally mounted to the counter.

Yet still another feature of the present invention is that it further includes a check valve arrangement disposed between sad carbon dioxide cylinder and the counter.

Still yet another feature of the present invention is that the check valve arrangement includes a push pin, and the handle includes a protrusion that rests on the push pin.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

Figure 1:
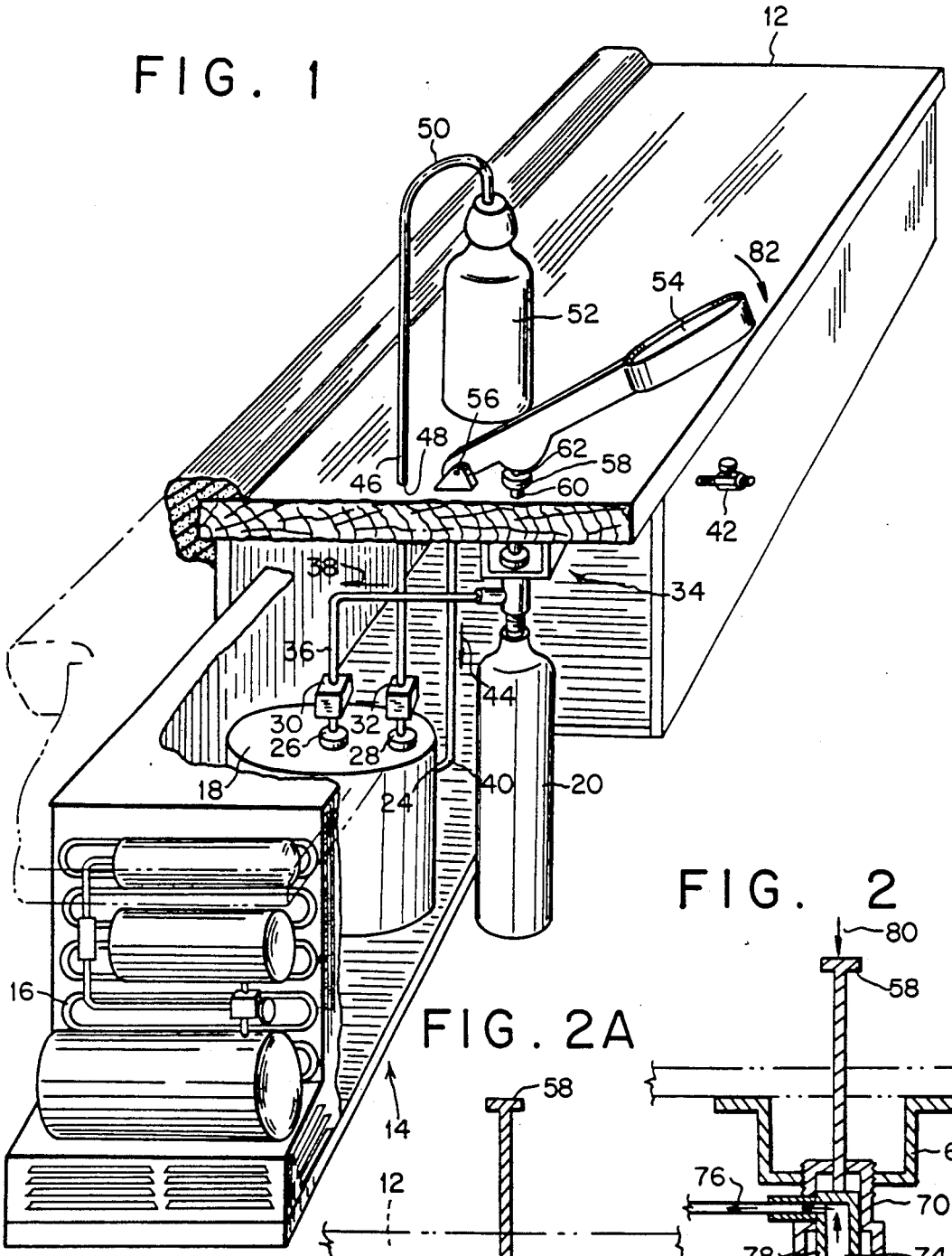
FIG. 1 is a perspective view of a counter with integral carbonated beverage dispenser.

10—counter with integral carbonated beverage dispenser
12—counter containing integral carbonated beverage dispenser 10
14—platform of counter 12
16—refrigerating unit for making drum 18 cold
18—mixing drum for mixing the water and the $CO_2$
20—cylinder of carbon dioxide
22—contents of the mixing drum 18
24—water inlet orifice on the mixing drum 18
26—carbon dioxide inlet orifice on the mixing drum
28—carbonated beverage outlet orifice on the mixing drum 18
30—check valve for the carbon dioxide inlet 26
32—check valve for the carbonated beverage outlet 28
34—check valve arrangement for the tank 20 of carbon dioxide
36—carbon dioxide conduit
38—arrow showing the direction of flow of the carbon dioxide in the tank 20
40—water conduit
42—manually operated valve for inputting water
44—arrow showing the direction of flow of the water
46—carbonated beverage conduit
48—orifice in counter 12
50—a curved chrome plated outlet pipe
52—bottle
54—dispensing handle
56—pivot point of the handle 54
58—push pin of the check valve arrangement 34
60—orifice in counter 12
62—protrusion on the handle 54
64—valve body of the check valve arrangement 34
66—internal spring in the check valve arrangement 34
68—"U"-channel for mounting the check valve arrangement 34 to the counter 12
70—one end of the check valve arrangement 34
72—other end of the check valve arrangement 34
74—passage
76—outlet of the carbon dioxide cylinder
78—shoe
80—arrow indicating direction of pressure applied to the push pin 58
82—arrow indicating direction of handle 54
84—bottle with self dispensing means
86—substantially cylindrical body
88—flat bottom of the substantially cylindrical body 86
90—domed top of the substantially cylindrical body 86
92—spout of the substantially cylindrical body 86
94—arm of the substantially cylindrical body 86
96—dowel-like portion of arm 94
98—extension of dowel-like portion of arm 94
100—spring of arm 94
102—hollow tube in body 86
104—center of bottle 84
106—lower free end of hollow tube 102
108—upper end of hollow tube 102
110—check valve on upper end 108 of hollow tube 102
112—rod
114—one end of rod 112
116—a pipe disposed in the body 86
117—other end of rod
118—threaded connector
120—orifice
122—check valve on threaded connector 50
124—water level in bottle 84
126—arrow showing direction of travel of the dowel-like arm 94
128—dome chamber

DETAILED DESCRIPTION OF THE PREFERRED EMBODIMENT

Referring now to FIG. 1, the counter with integral carbonated beverage dispenser is shown generally at 10.

The components are located under the counter 12 mounted to a bottom platform 14. Located on the platform 14 are a refrigerating unit 16, a mixing drum 18, a cylinder 20 of carbon dioxide, and various valving, piping, connectors, etc.

The refrigerating unit 16 maintains the mixing drum 18 at a low temperature so as to increase the taste of the carbonated beverage in the mixing drum 18.

The mixing drum 18 is substantially cylindrical and contains three orifices 24, 26, and 28. The orifice 24 is the water inlet. The orifice 26 is the carbon dioxide inlet. The orifice 28 is the carbonated beverage outlet.

Mounted on the mixing drum 18, at the carbon dioxide inlet 26, is a check valve 30.

Mounted on the mixing drum 18, at the carbonated beverage outlet 28 is a check valve 32.

A conduit 36, originates at the carbon dioxide cylinder 20 and terminates at the check valve 30. The check valve 30 prevents the carbon dioxide in the line 36 from backing up into the cylinder 20. Arrow 38 shows the direction of flow of the carbon dioxide from the cylinder 20.

A water conduit 40, originates at the manual operated valve 42 and terminates at the mixing drum 18. Arrow 44 shows the direction of flow of the water.

A carbonated beverage conduit 46 originates at the check valve 32, passes through an orifice 48 in the counter 12, and terminates in a curved, chrome plated outlet pipe 50 used for dispensing the prepared carbonated beverage. The check valve 32 prevents the carbonated beverage in the line 46 from backing up into the mixing drum 18.

A bottle receptacle 52 is filled with and holds the prepared carbonated beverage until use, that is, the bottle 56 is removed and stored until use.

A dispensing handle 54 is pivotally mounted to the counter 12 at pivot point 56.

The check valve arrangement 34 includes a push pin 58 that passes through an orifice 60 in the counter 12 and remains passive while a protrusion 62 on the handle 54 rests on the push pin 58.

Figure 2:
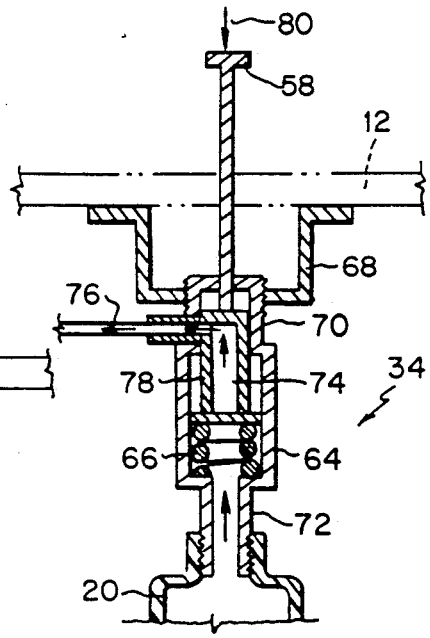
FIG. 2 is a cross-sectional view of the valving for the $CO_2$ cylinder, in the open position, and mounted on top of the $CO_2$ cylinder as shown in FIG. 1.
Figure 2A:
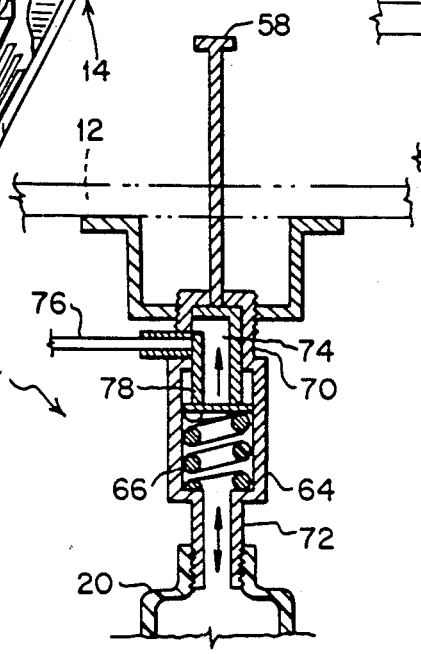
FIG. 2A is a cross sectional view of the valving for the $CO_2$ cylinder, in the closed position, and mounted on top of the $CO_2$ tank as shown in FIG. 1.

The check valve arrangement 34 for the carbon dioxide cylinder 20 can best be seen in FIGS. 2 and 2A.

The check valve arrangement 34, shown in FIG. 2A is in the passive state. That is, no pressure is being applied to the push pin 58. The check valve arrangement 34 contains a valve body 64 with an internal spring 66. The check valve arrangement 34 is mounted at one end 70 to the counter 12 by use of a "U"-channel 68. While the other end 72 is threaded into the cylinder 20 of carbon dioxide.

As can be seen, when the check valve arrangement 34 is in the passive state, the carbon dioxide occupies only the passage 74, since the outlet 76 is blocked by a shoe 78.

The check valve arrangement 34, shown in FIG. 2, is in the active state. That is, pressure is being applied to the push pin 58 in the direction of arrow 80 until the outlet 76 is in line with the passage 74, the carbon dioxide then passes from the passage 74 to the outlet 76 of the carbon dioxide cylinder 20.

In operation, the refrigerating unit 16 is activated so that the water coming from the valve 42 and entering the mixing drum 18 is chilled before the carbon dioxide enters the mixing drum 18. When mixing drum 18 contains the required amount of water, the valve 42 is manually closed.

The handle 54 is pressed down in the direction of arrow 82 until the protrusion 62 meets the push pin 58. Pressure is continually applied to the push pin 58 until the push pin 58 displaces the shoe 78 so that the passage 74 is in fluid communication with the outlet 76.

The carbon dioxide then leaves the cylinder 20 and proceeds through the carbon dioxide conduit 36, passes check valve 30, and through orifice 26 into the mixing drum 18. The water and the carbon dioxide are mixed, and leave the mixing drum 18 via the orifice 28, through the check valve 32, through the orifice 48, through a curved chrome plated outlet pipe 50, and into the bottle 52.

Figure 3:
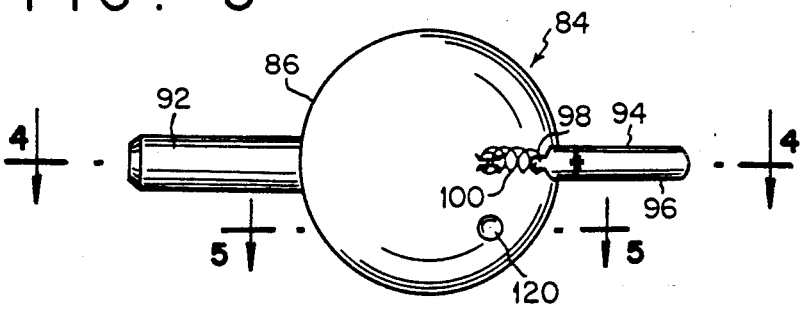
FIG. 3 is a plan view of an active bottle used to store the carbonated beverage until needed.
Figure 4:
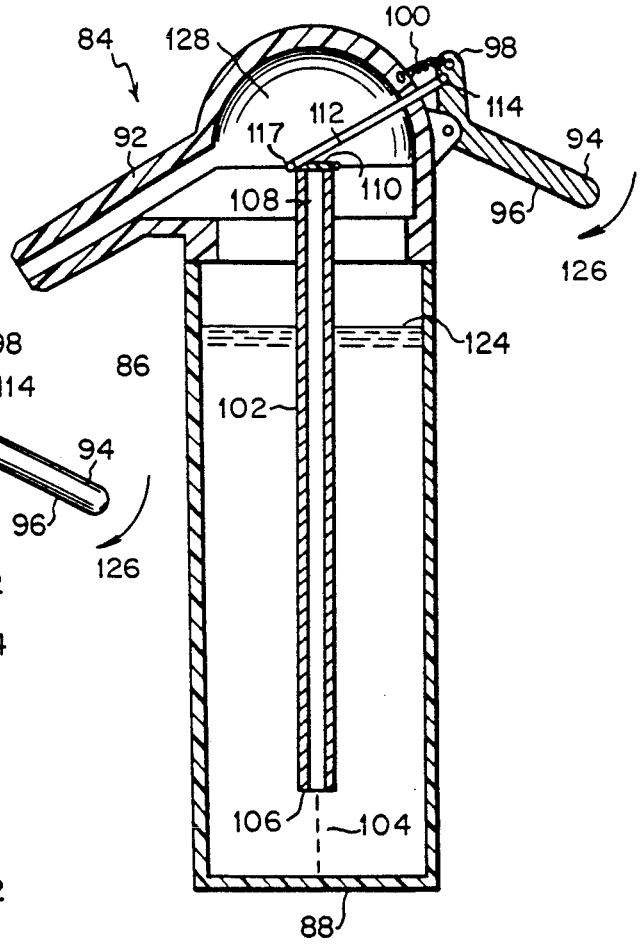
FIG. 4 is a cross sectional view of the active bottle taken along line 4—4 of FIG. 3.
Figure 5:
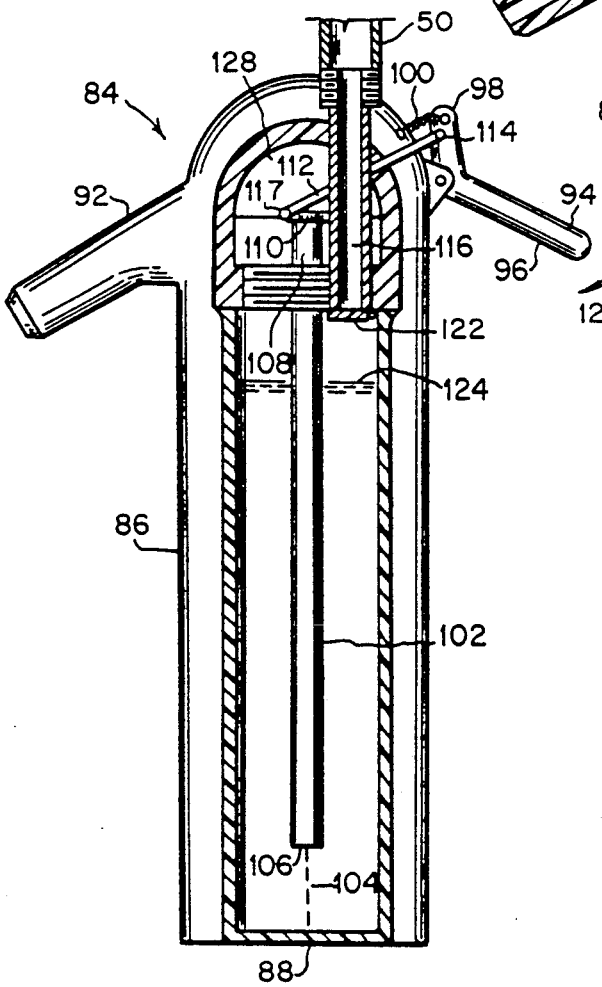
FIG. 5 is a cross sectional view of the active bottle taken along line 5—5 of FIG. 3.

As shown in FIGS. 3, 4, and 5, the bottle 84 has self-dispensing means.

The bottle 84 has a substantially cylindrical body 86 with a flat bottom 88 and a domed top 90.

A spout 92 is rigidly affixed to and extends from the cylindrical body 86 for dispensing the fluid. As shown, the spout 92 and the cylindrical body 86 can be of a one piece construction.

An arm 94 is pivotally mounted to the exterior of the substantially cylindrical body 86. The arm 94 has a dowel-like portion 96 and an extension 98 attached to but offset from the dowel-like portion 96, and which is biased by spring 100.

The bottle 84 contains a hollow tube 102 disposed down its center 104. The tube 102 has a lower free end 106 which sits in the fluid. The tube 102 has an upper end 108 which is capped by a check valve 110.

A rod 112 is attached at end 114 to the extension 98, and at end 117 to the check valve 110.

A pipe 116 with a threaded connector 118 passes through orifice 120. The bottle can be filled by connecting the conduit 50 to the pipe 116.

In operation, the conduit 50 is attached to the pipe 116. The pressure of the incoming fluid opens check valve 122 and the fluid now begins to fill the bottle 84. As the fluid begins to rise in the bottle 86 until a fluid level 124 is achieved. As long as the check valve 110 is closed the bottle 86 will remain passive.

In order to operate the bottle 86, the user pushes arm 94 in the direction of arrow 126. This causes the rod 112 to lift and open the check valve 110. When the check valve 110 is opened, the fluid enters the tube 102 at its free end 106. the fluid and then enters the dome chamber 128 and leaves by way of the spout 92.

It will be understood that each of the elements described above, or two or more together, may also find a useful application in other types of constructions differing from the type described above.

While the invention has been illustrated and described as embodied in a counter with integral carbonated beverage dispenser, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A counter with internal carbonated beverage dispenser, comprising:

a) a counter with a bottom platform;

b) a cylindrical mixing drum containing three orifices and being disposed on said bottom platform and under said counter, said three orifices being a water inlet, a carbon dioxide inlet, and a carbonated beverage outlet, said carbon dioxide inlet containing a dispensing valve so that said carbon dioxide will flow to said mixing drum only when a drink is required;

c) a refrigerating unit disposed on said bottom platform and under said counter, said refrigerating unit being disposed adjacent to said mixing drum so that the contents of said mixing drum remain cold;

d) a separate carbon dioxide cylinder disposed on said bottom platform and under said counter so that all of the unsightly components are hid under the counter out of site.

2. A dispenser as defined in claim 1, wherein said carbonated beverage outlet contains a check valve so that said carbonated beverage flows only in one direction.

3. A dispenser as defined in claim 2; further comprising a carbon dioxide conduit connecting said carbon dioxide cylinder to said check valve at said carbon dioxide inlet so that said carbon dioxide in said cylinder flows only in one direction.

4. A dispenser as defined in claim 3; further comprising a water conduit connecting said mixing drum to a water supply.

5. A dispenser as defined in claim 4; further comprising said carbonated beverage conduit connecting said carbonated beverage outlet to an outlet pipe.

6. A dispenser as defined in claim 5; further comprising a check valve arrangement disposed intermediate said carbon dioxide cylinder and said counter.

7. A dispenser as defined in claim 6; further comprising a handle pivotally mounted to said counter and resting on said check valve arrangement disposed intermediate said carbon dioxide cylinder and said counter.

8. A dispenser as defined in claim 7, wherein said check valve arrangement includes a push pin, and handle which includes said protrusion that rests on said push pin.

* * * * *